US006971299B2

(12) United States Patent
Franzén et al.

(10) Patent No.: US 6,971,299 B2
(45) Date of Patent: Dec. 6, 2005

(54) COUNTERMASS WEAPON

(75) Inventors: Arne Franzén, Karlskoga (SE); Lars-Ake Carlqvist, Karlskoga (SE); Lars Ax, Tullinge (SE); Eje Lantz, Eskilstuna (SE)

(73) Assignee: SAAB AB, Linkoping (SE)

( * ) Notice: Subject to any disclaimer, the term of this patent is extended or adjusted under 35 U.S.C. 154(b) by 0 days.

(21) Appl. No.: 10/502,887

(22) PCT Filed: Jan. 15, 2003

(86) PCT No.: PCT/SE03/00044

§ 371 (c)(1),
(2), (4) Date: Dec. 9, 2004

(87) PCT Pub. No.: WO03/064956

PCT Pub. Date: Aug. 7, 2003

(65) Prior Publication Data

US 2005/0115392 A1 Jun. 2, 2005

(30) Foreign Application Priority Data

Jan. 31, 2002 (SE) ..... 0200281

(51) Int. Cl.[7] ..... F41A 1/08

(52) U.S. Cl. ..... 89/1.701; 89/1.702; 102/437

(58) Field of Search ..... 42/1.06; 89/1.7, 89/1.701, 1.702; 102/437

(56) References Cited

U.S. PATENT DOCUMENTS

| | | | | |
|---|---|---|---|---|
| 4,050,351 A | | 9/1977 | Stauff | |
| 4,073,213 A | * | 2/1978 | Stauff | 89/1.701 |
| 4,244,293 A | | 1/1981 | Grosswendt et al. | |
| 4,643,071 A | | 2/1987 | Baechler et al. | |
| 5,337,648 A | * | 8/1994 | Brage | 89/1.704 |
| 5,357,841 A | * | 10/1994 | Clark et al. | 89/1.701 |
| 5,551,330 A | * | 9/1996 | Reuche | 89/1.701 |
| 5,952,601 A | * | 9/1999 | Sanford et al. | 89/1.706 |
| 6,446,535 B1 | * | 9/2002 | Sanford et al. | 89/1.701 |

FOREIGN PATENT DOCUMENTS

| | | |
|---|---|---|
| SE | 408091 B | 5/1979 |
| SE | 467594 B | 8/1992 |

* cited by examiner

*Primary Examiner*—J. Woodrow Eldred
(74) *Attorney, Agent, or Firm*—Connolly Bove Lodge & Hutz LLP; Larry J. Hume

(57) ABSTRACT

The subject invention concerns a general method of producing countermass weaponry and is based on the use of a high-pressure system and a low-pressure system with a countermass (12, 26, 26', 38) acting against the low-pressure system. The high-pressure system (7, 23, 23', 36) shall, in practice, be formed by the combustion chamber for the weapon propellant charges (8, 22, 22', 35) while the main part of the low-pressure system (25, 25') shall, in initial stages, be formed by the storage and acceleration chamber for the countermass. The advantage of the subject invention is that said invention offers a possibility of achieving lower pressure levels around the grunner without, for such an end, diminishing the range of the weapon (1, 13).

24 Claims, 3 Drawing Sheets

COUNTERMASS WEAPON

The subject invention treats a general method of producing an improved type of countermass weapon of the selectable reloadable or disposal type(s). In accordance with said method of weapon so produced, the subject invention also includes the special properties of such weapons. These weapons, according to the invention, have the chief advantage of affording low pressure increases around the gunner. Such a weapon, being of the type distinguished by the invention, can thus be fired from within confined spaces, as during urban combat, without risk to the gunner. The need for weapons of said type has long been known and although there exist today a number of different, in principle, recoilless or reloadable weapons of backblast and/or countermass type, that are both easily handled by the gunner and highly effective in-target, it is relatively few of these that combine these properties with the property being able to be fired from confined spaces while maintaining an acceptable range and posing no risks to the gunner. The subject invention, offering said advantages, makes it possible to manufacture shells for said reloadable backblast weapons that convert such weapons to countermass weapons with the distinguishing properties of the subject invention, such being an acceptably low pressure increases around the gunner, which is not at the cost of limiting the range of the weapon.

Over time, much work has been devoted to the selection and consistency of the countermass used in the different types of weapons, because one can state from an early stage that the selection of the countermass affects the pressure increase around the countermass weapon fired as well as the backflash behind the weapon. An additional advantage of countermass is the radically reduced weapon heat signature due to the extinguishing of the backflash behind the weapon to a greater or lesser extent. A special problem in relation to attempts at achieving lower pressure increases around the gunner have concerned the unacceptability of lower pressure increases being achieved at the cost of gross reductions in the range of the weapon, thus reducing general usability in the open.

The subject invention now offers a general method of reducing the pressure increase around the weapon generated upon firing, thus said invention can form the basis of a new family of countermass weapons, encompassing reloadable as well as disposal type(s). The Carl-Gustaf recoilless rifle is a renowned example of such a reloadable weapon. The subject invention also includes a general method, in accordance with the method indicated in the subject invention, to make use of countermass in such recoilless weapons in which the projectile fired normally reaches the desired muzzle velocity according to the so called backblast principle. The projectile, for weapons of this type, achieves the desired muzzle velocity from a propellant charge as the recoil of the weapon is simultaneously countered by the same propellant charge in so far as said charge is fired rearwards of the direction of projectile fire in the rear-opened barrel. The subject invention now offers a general method of reducing the pressure increase around the weapon generated upon firing, thus said invention can form the basis of a new family of countermass weapons, encompassing reloadable as well as disposal type(s). The Carl-Gustaf recoilless rifle is a renowned example of such a reloadable weapon. The subject invention also includes a general method, in accordance with the method indicated in the subject invention, to make use of countermass in such recoilless weapons in which the projectile fired normally reaches the desired muzzle velocity according to the so called backblast principle. The projectile, for weapons of this type, achieves the desired muzzle velocity from a propellant charge as the recoil of the weapon is simultaneously countered by the same propellant charge in so far as said charge is fired rearwards of the direction of projectile fire in the rear-opened barrel.-{}- The barrels of backblast weapons en in a widening conical gas outlet, which, initially, partially limit the rearwards free-release area of the barrel. It is thus suggested, in reference to the subject invention, that two different assembled propellant charges be used for the Carl-Gustaf recoilless rifle. The barrels of backblast weapons en in a widening conical gas outlet, which, initially, partially limit the rearwards free-release area of the barrel. It is thus suggested, in reference to the subject invention, that two different assembled propellant charges be used for the Carl-Gustaf recoilless rifle.

The subject invention is based on the utilisation of a generally high-pressure low-pressure system combined with countermass counteracting the low-pressure system. The high-pressure system shall, in practice, be formed by the combustion chamber for the weapon propellant charges while the main part of the low-pressure system shall, in initial stages, be formed by the storage and acceleration chamber for the countermass. The possibility, earlier intimated in the subject invention, of utilising the general high-pressure low-pressure countermass system in one and the same weapon that, in similarity to the Carl-Gustaf recoilless rifle, includes a constrictive nozzle and in normal cases functions according to the backblast principle, is achieved by equipping the cartridge casing of the weapon's attendant ammunition with a device that affords the cartridge casing an inner low-pressure chamber, which has a diameter equalling the free area at the outlet nozzle of the weapon. The concentric space, fashioned outside said low-pressure chamber that is limited by the constriction of the outlet nozzle rearwards of the weapon's direction of fire, can in a preferable form of execution be used as a high-pressure chamber or, in some other variant, an equivalent filling.

The subject invention can be used as a booster charge or launch charge for weapons with longer ranges, where a flight motor of the rocket motor sort ignites later in the shell's own trajectory. A booster charge can be developed in accordance with the method described in the subject invention for weapons without requirements for longer ranges that affords the shell sufficient muzzle velocity for most purposes.

The basic concept for the subject invention, as regards reusable weapons, concerns a new kind of cartridge casing appropriately adapted that can be of two different types, to be described later on in the text.

The same basic concepts can be used for disposable weapon by the rear parts of the weapon barrel, opposed to the direction of fire of the weapon, are specially formed by a method corresponding to that of the cartridge casing in the case of reusable or reloadable weapons.

The basic concept for the method and device according to the subject invention, that has been intimated earlier concerns using a propellant charge, for the acceleration and launch of the given projectile, combusted in a limited area high-pressure chamber, from which the propellant gases are fed, through specially adapted overflow channels, to a low-pressure chamber or expansions chamber fashioned behind the rear end of said given projectile and between it and a countermass or dampening mass that shall initially adsorb the main part of the forces from the low-pressure chamber or expansion chamber. Thus, the projectile accelerates in a forward direction, given the successive feed of propellant gases to the low-pressure or expansion chamber, within and out of the barrel muzzle at the same time as the countermass accelerates in a rearward direction out of the rear outlet of the barrel. The internal ballistic process within the barrel can, thus, be controlled by the amount of propellant and rate of combustion for said propellant in the high-pressure chamber and by balancing the form and lead-through area of the overflow channels between the high-pressure and low-pressure chambers with the amount and type of countermass for the desired muzzle velocity of the given projectile and the outflow velocity of the countermass and the method by which said countermass is to be installed.

The division into high-pressure and low-pressure chambers also afford certain other possibilities beyond the main notion of limiting pressure increases around the weapon. By positioning the gas overflow openings obliquely towards the countermass, which is to say backwards in relation to the direction of flight of the given projectile, it is possible to partially eliminate the recoil of the weapon.

The present invention is defined in the subsequent patent claims and is now described in more detail with reference to the illustrations shown in the appended Figures.

FIG. 1 depicts a longitudinal section of a disposable auxiliary support weapon, while

Figure 1:
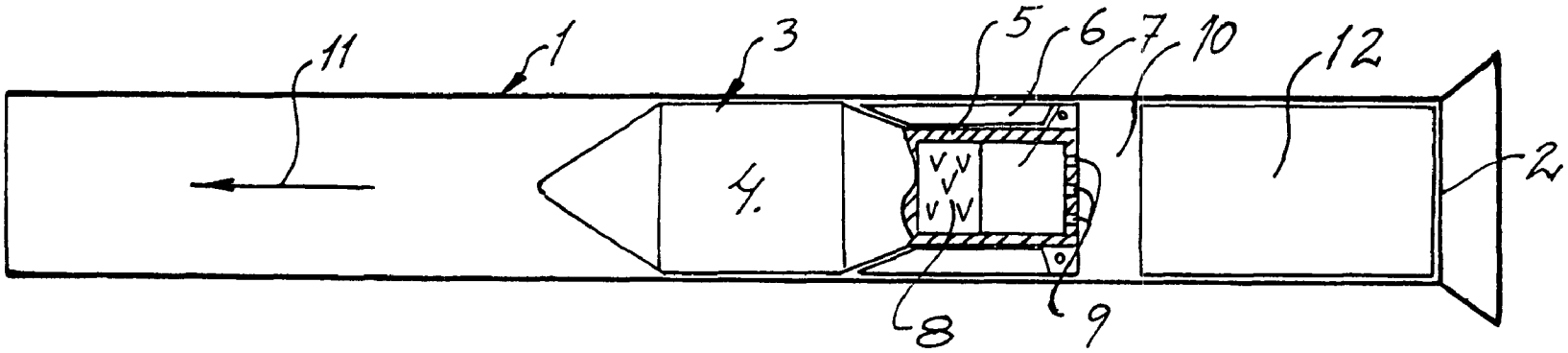
Figure 2:
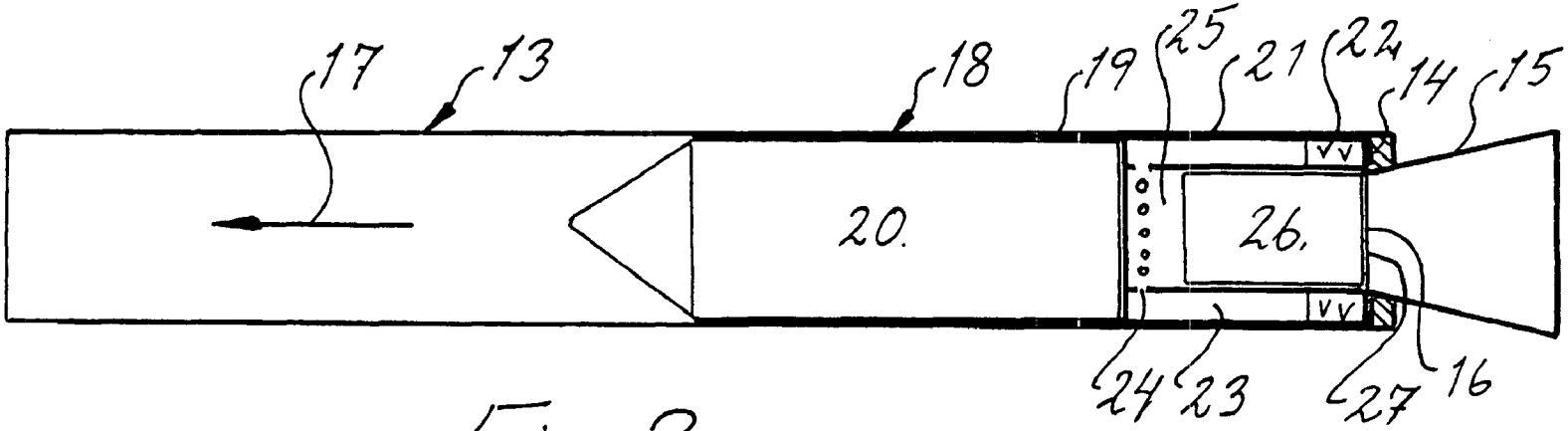
FIG. 2 depicts a longitudinal section of a reloadable anti-tank weapon that normally functions according to the backblast principle but, here, is converted to a countermass weapon by virtue of the shell, which distinguishes the subject invention.

The main parts essential for the subject invention for the disposable weapon shown in FIG. 1 are the same as those depicted in FIG. 2.

Thus, the weapon as depicted in FIG. 1, in principle includes an open barrel 1. Though the barrel, until the moment of firing, can have its forward end covered with a disposable protective cap, not shown in the Figure, and its rear end covered by a similar disposable bottom plate, here numerically designated as 2, this does not change the fact that the barrel 1, during the launch itself, functions as a barrel open at both ends. In barrel 1 there is devised that projectile 3 to be fired through the barrel and thereupon has been assigned a previously determined muzzle velocity. The projectile 3 has a forward warhead 4, whose parts are, here, not included in the Figure, and a rear propulsion section 5, shown in cross section. The Figure also depicts some guidance fins retracted under the projectile, though these are later deployed in flight outside the barrel. The propulsion section 5 of the projectile 3 is principally made up of a high-pressure chamber 7 built into the projectile that initially is only partially filled with propellant 8. A number of constrictive gas outlets 9 lead from the high-pressure chamber to a low-pressure chamber or expansion chamber 10, which is initially formed by a space behind the projectile. The propellant gases flowing in through the gas outlets 9 in the low-pressure chamber 10 shall, in part, affect the rear plane of the projectile 3 in the direction of fire 11 and shall, in part, in the opposite direction, affect the countermass 12, fashioned in an appropriate packing in the rear section of the barrel 1. When the pressure in the low-pressure chamber 10 has exceeded a predetermined value, the projectile 3 shall accelerate in the direction of fire 11 at the same time as the countermass forces away the bottom plate 2 and begins, itself, to accelerate in the opposite direction.

The reloadable weapon depicted in FIG. 2 consists of a barrel 13 whose rear end is equipped with a rear plane 14, with an outlet nozzle 15, whose constrictive inner section 16 partially limits the rearward available free area of the weapon, relative to the direction of fire 17. The weapon is loaded with a complete round 18, inclusive of a cartridge casing 19 and a projectile 20. Included in the cartridge casing 19 is a propulsion section 21, which remains in the barrel after firing. This propulsion section, initially only partially filled with propellant 22, consists of an outer high-pressure chamber 23, from which a number of constrictive gas overflow openings 24 lead to a low-pressure chamber 25. There are devised, as a direct continuation to the low-pressure chamber 25 and by the method corresponding to that of the weapon depicted in FIG. 1, a given projectile for the weapon and an appropriately packed countermass 26 adjusted to muzzle velocity. Initially, the countermass 26 is held in place with a bottom plate 27, which covers the outlet opening 16. By locating the high-pressure chamber 23 concentrically with but outside of the space occupied by the countermass 26, the space available for said countermass has been limited to the free area 16 of the outlet nozzle, which means that the weapon, that would normally fire ammunition of the backblast type, has been modified for firing ammunition of the countermass type by using said special type of round (as depicted in FIG. 2).

Generally, as regards the small scale of FIG. 1 and FIG. 2, many components not directly affecting the subject invention, itself, such as the firing mechanism etc., have not been depicted therein.

Figure 3:
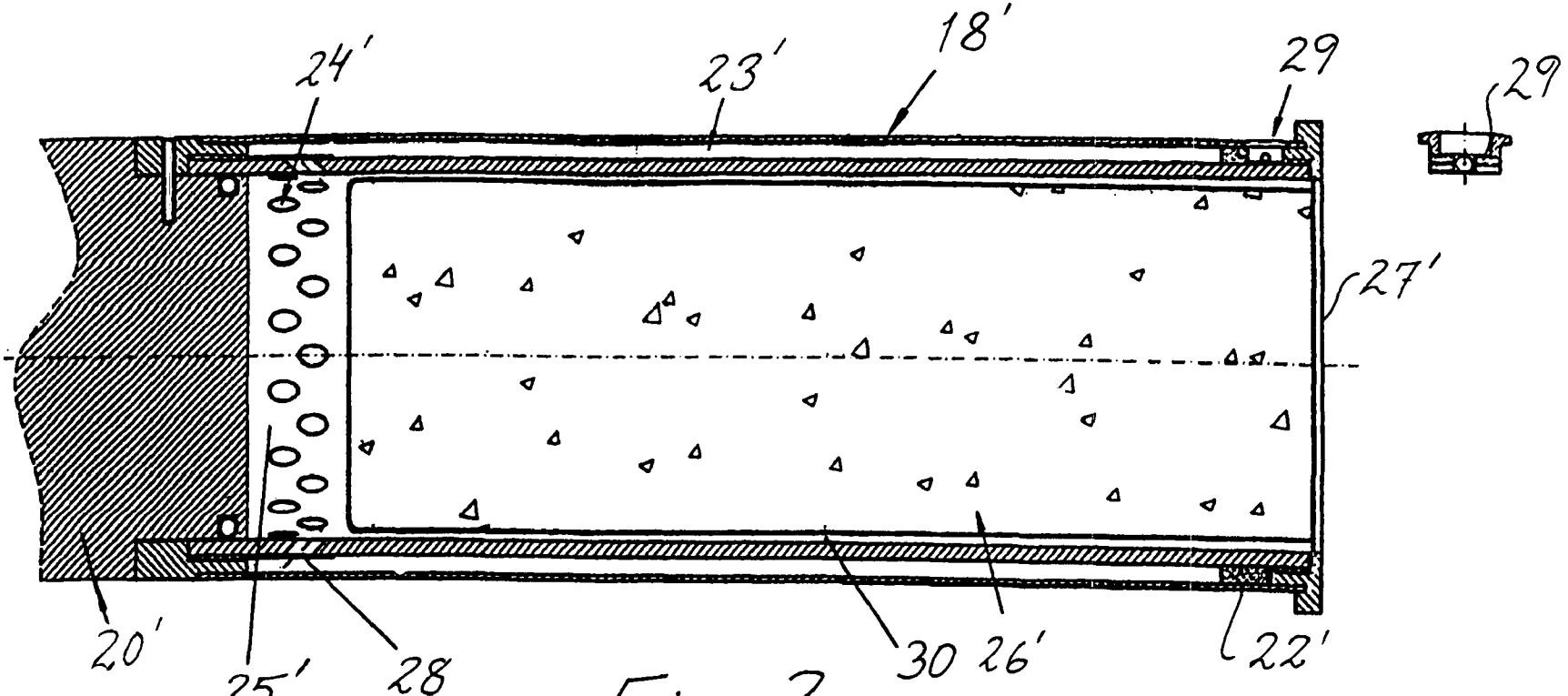
FIG. 3 depicts the first type of shell, intended for the weapon depicted in FIG. 2 in greater detail.

FIG. 3 depicts the shell 18', according to FIG. 2, but with the different parts in the correct scale and with some added components. The same numerical designations appear in FIG. 3 affixed with recursive sign ' after the numerical designation to the extent that the same components appear in both FIG. 2 and FIG. 3. Thus, thus shell 18', the projectile 20' (though only partially depicted) and the countermass 26', etc., are all to be found in FIG. 3. There are also certain further components depicted in FIG. 3 that were not included in FIG. 2. As said gas overflow openings 24' are thus partially directed obliquely rearwards of the direction of fire of the given projectile 20', and are partially covered in bursting foil 28, which shall be eliminated by the propellant pressure in the high-pressure chamber 23', thereby shall the recoil impacting the weapon be eliminated. There is also an igniter 29 for the propellant charge depicted. Said igniter essentially consists of a conventional percussion cap device in a control cup that controls the ignition spark of the percussion cap in two diametrical directions so that the ring-formed propellant charge 22' ignites in two directions. Thus, the result shall be two ignition pulses that shall meet after a half a revolution of the shell each.

Further, it is shown in FIG. 3 that there is a thin slot 30 around the exterior packing of the countermass 26' and the interior of the low-pressure chamber 25' extension. Said slot 30, preferably achieved with thin longitudinal guideways, shall primarily be tasked with propellant gas lubrication between the countermass packing and the wall of the low-pressure chamber and prevents the countermass from being obstructed in its the path out of the said low-pressure chamber by jamming or by some other cause.

Figure 4:
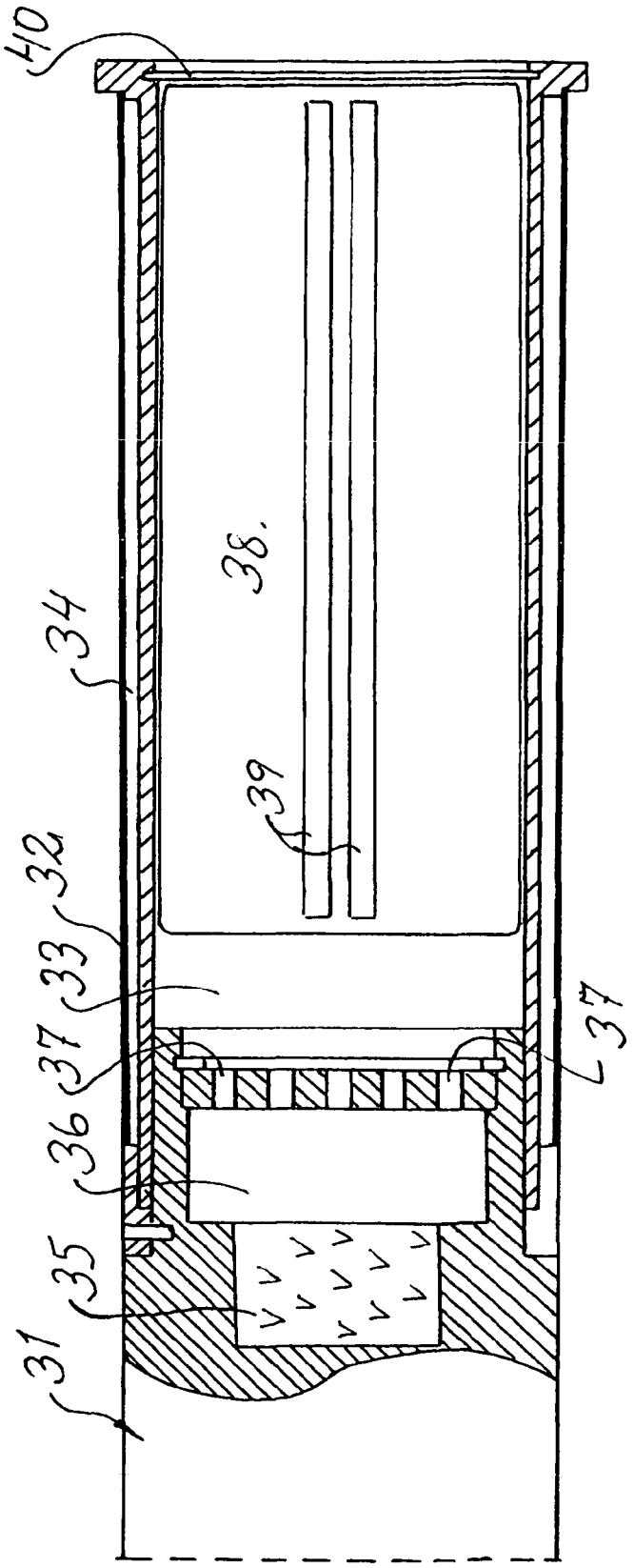
FIG. 4 depicts the second type of shell for the weapon in FIG. 2.

FIG. 4 depicts another variant of a shell for a reloadable weapon. This shell entails a projectile 31 (only partially depicted), a cartridge casing 32 equipped with an internal low-pressure chamber 33 that, in similarity to said low-pressure chamber in FIG. 2 and FIG. 3, has its internal diameter adapted to the interior dimensions of the outlet nozzle of the weapon (numerically designated as 16 in FIG. 2). The aforementioned space forming said high-pressure chamber in FIG. 3 has only been depicted, here, as filler 34. This is because the propellant charge, here with numerical designation 35, together with the high-pressure chamber 36 and gas overflow openings 37 are built into the rear section of the projectile 31. Said packed countermass, here, has numerical designation 38, said guideways, renamed in relation to FIG. 3, have numerical designation 39 and the expellable bottom plate of the cartridge casing 32 has numerical designation 40. Otherwise this projectile variant functions entirely in the same way as described earlier for FIGS. 1–3.

What is claimed is:

1. A weapon, comprising:

a barrel having an outlet at a rear of the barrel;

a countermass disposed at the rear of the barrel; and a projectile disposed within the barrel, the projectile comprising:

a propellant disposed at a rear of the projectile and in communication with a high pressure chamber;

at least one opening at the rear of the projectile that is disposed to allow propellant gases to exit the high pressure chamber; and a low pressure chamber disposed between the at least one opening and the countermass to receive gases exiting the high pressure chamber.

2. The weapon of claim 1, wherein the at least one opening comprises a plurality of constrictive outlets.

3. The weapon of claim 1, comprising:

a bottom plate disposed at a rear of the countermass.

4. The weapon of claim 1, wherein the projectile comprises a forward warhead and a plurality of guidance fins.

5. The weapon of claim 1, comprising:

a cartridge casing at a rear of the projectile, wherein the countermass is disposed within the cartridge casing.

6. The weapon of claim 5, wherein the countermass has guideways extending along its length.

7. The weapon of claim 1, wherein the projectile comprises a forward warhead and a plurality of guidance fins.

8. The weapon of claim 1, wherein the projectile comprises a forward warhead and a plurality of guidance fins.

9. A method of firing a weapon, comprising:

providing a weapon according to claim 1; and firing the projectile from the barrel, wherein during firing, propellant gases initially combust in the high pressure chamber and exit the high pressure chamber through the at least one opening and then enter the low pressure chamber, forcing the countermass out of a rear section of the barrel.

10. The method of claim 9, wherein the high pressure chamber is initially sealed.

11. The method of claim 9, wherein propellant charge is disposed within the high pressure chamber.

12. The method of claim 9, wherein the high pressure chamber is aligned with the low pressure chamber, and wherein the chambers are separated by a disc containing the overflow openings.

13. A weapon, comprising:

a barrel having an outlet at a rear of the barrel;

a countermass disposed at the rear of the barrel;

a projectile disposed within the barrel forward of the countermass;

a propellant disposed in the barrel and in communication with a high pressure chamber;

a low pressure chamber in communication with the countermass; and at least one opening disposed between the low pressure chamber and the high pressure chamber to allow propellant gases to exit the high pressure chamber and contact the countermass.

14. The weapon of claim 13, wherein the at least one opening comprises a plurality of constrictive outlets.

15. The weapon of claim 13, comprising:

a bottom plate disposed at a rear of the countermass.

16. The weapon of claim 13, wherein the high pressure chamber is located concentrically with the low pressure chamber.

17. The weapon of claim 15, comprising:

an outlet nozzle at a rear of the barrel adjacent to the bottom plate.

18. The weapon of claim 17, wherein countermass, propellant, low pressure chamber and high pressure chamber form a propulsion section, and wherein the propulsion system and the projectile form a shell.

19. The weapon of claim 17, wherein the weapon is reusable, and wherein shell has an interior diameter that is less than or equal to a free area of the outlet nozzle.

20. The weapon of claim 13, wherein the at least one opening is angled so as to direct propellant gases towards the countermass.

21. A method of firing a weapon, comprising:

providing a weapon according to claim 13; and firing the projectile from the barrel, wherein during firing, propellant gases initially combust in the high pressure chamber and exit the high pressure chamber through the at least one opening and then enter the low pressure chamber, forcing the countermass out of a rear section of the barrel.

22. The method of claim 21, wherein the high pressure chamber is initially sealed.

23. The method of claim 21, wherein propellant charge is disposed within the high pressure chamber.

24. The method of claim 21, wherein propellant gases flow obliquely backwards towards the countermass, the angle of obliquity being calculated to control recoil.

* * * * *